US006659009B1

(12) United States Patent
Jordan

(10) Patent No.: US 6,659,009 B1
(45) Date of Patent: Dec. 9, 2003

(54) DRILLED-IN FILTER FOR GAS GENERATING INITIATOR

(75) Inventor: Bruce Jordan, LaPlata, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/208,824

(22) Filed: Aug. 1, 2002

(51) Int. Cl.[7] ..... C06C 7/00; F42B 3/12

(52) U.S. Cl. ..... 102/202; 102/202.14; 102/204; 102/470; 102/530; 280/741

(58) Field of Search ..... 102/202, 202.5, 102/202.6, 202.7, 202.8, 202.9, 202.14, 204, 275.6, 380, 430, 469, 470, 530, 531; 280/736, 741, 742

(56) References Cited

U.S. PATENT DOCUMENTS

| | | | | |
|---|---|---|---|---|
| 2,995,088 A | * | 8/1961 | Asplund | |
| H124 H | | 9/1986 | Antonuzzi et al. | 102/254 |
| 4,856,433 A | * | 8/1989 | Evans | 102/530 |
| 5,192,829 A | * | 3/1993 | Suire | 102/204 |
| 5,496,064 A | | 3/1996 | Osborne et al. | 280/740 |
| 5,634,661 A | | 6/1997 | Dahl et al. | 280/741 |
| 5,675,115 A | * | 10/1997 | Hershkowitz et al. | 102/202 |
| 6,328,337 B1 | | 12/2001 | Katsuda et al. | 280/741 |
| 6,338,500 B1 | | 1/2002 | Perotto | 280/714 |
| 2001/0042298 A1 | | 11/2001 | Katsuda et al. | 29/463 |

FOREIGN PATENT DOCUMENTS

| | | | | |
|---|---|---|---|---|
| DE | 315857 | * | 6/1920 | 102/204 |

* cited by examiner

*Primary Examiner*—Harold J. Tudor
(74) *Attorney, Agent, or Firm*—Mark Homer

(57) ABSTRACT

A gas generating initiator includes a generally cylindrical body defining an initiator chamber therein, the body being open at one end and closed at a second end by a base, the body having a longitudinal axis; the base including a generally centrally located first passage therethrough having one end on an interior surface of the base and a second end on an exterior surface of the base, a longitudinal axis of the first passage being substantially coincident with the axis of the body; and a plurality of second passages in the base, the second passages having one end on an interior surface of the base and a second end that intersects the first passage at the second end of the first passage, wherein longitudinal axes of the second passages form angles with the longitudinal axis of the first passage and wherein a diameter of the first passage is greater than diameters of the second passages.

13 Claims, 2 Drawing Sheets

DRILLED-IN FILTER FOR GAS GENERATING INITIATOR

STATEMENT OF GOVERNMENT INTEREST

The invention described herein may be manufactured and used by or for the Government of the United States of America for government purposes without the payment of any royalties therefor.

BACKGROUND OF THE INVENTION

The invention relates in general to gas generating initiators and in particular to gas generating initiators including a filter that prevents large particles from entering the generated gas stream.

FIG. 1 is a sectional view of a prior art gas generating initiator 10. Initiator 10 may be used in applications such as the launching of sonobuoys from aircraft, ejector seats in aircraft and the initiation of ballistic munitions.

Initiator 10 includes a generally cylindrical body 12 that defines an initiator chamber 14. The body 12 is open at one end 11 and closed at a second end by a base 13. The body 12 has a central longitudinal axis A—A. The base 13 includes a generally centrally located passage 15. Passage 15 has one end on an interior surface 17 of the base and a second end on an exterior surface 19 of the base. A longitudinal axis of the first passage 15 is substantially coincident with the axis A—A of the body 12. Adhesive is applied to the threads of a filter 30, discussed in more detail below, which is then threaded into passage 15. Body 12 and filter 30 may be made of, for example, aluminum, aluminum alloy, steel or steel alloy.

Initiator 10 includes a charge holder 16 disposed in the open end 11 of the body 12. The charge holder 16 includes a consumable membrane 18 at one end and gas generating propellant 20 disposed in the charge holder 16. Charge holder 16 may be made of plastic and snap fit into chamber 14. Consumable membrane 18 may be made of nitrocellulose. A cap 22 is attached to the open end 11 of the body 12, by, for example, threaded engagement. An igniter 24 is disposed in an opening in the cap 22 and extends into the charge holder 16. The igniter 24 ignites the propellant 20 in the charge holder 16. A firing mechanism 26 is connected to the igniter 24 for firing the igniter. The firing mechanism may be activated, for example, manually or by a variety of switches, such as inertial switches, accelerometers, etc.

In ballistic applications, gas exiting the passage 15 is routed to a munition by using a nipple 28 attached (for example, with threads) to the base end 13 of the initiator body 12. The nipple 28 includes a passageway 29 therethrough to provide a conduit for gas generated by the initiator.

FIGS. 2*a*–2*c* show details of a prior art filter 30. FIG. 2*a* is a top view of the filter 30 showing a hexagonal head 32. FIG. 2*b* is a sectional view along the line b—b of FIG. 2*a*. FIG. 2*c* is a sectional view along the line c—c of FIG. 2*b*. Head 32 is joined to a shank 34. The shank 34 is threaded and threads into passage 15. Head 32 includes five radial gas passages 36 that intersect in the center of head 32. The five radial passages 32 join an axial passage 38.

In use, the initiator 10 is operated by firing the firing mechanism 26 which sends an electric signal to igniter 24. Igniter 24 ignites propellant 20 thereby generating gas. Consumable membrane 18 bursts and/or burns and the generated gas enters the filter 30 via the five radial passages 32, then enters the axial passage 38 and then exits the initiator via passage 15. The radial passages 32 in filter 30 are small enough to prevent any large particles of propellant or pieces of charge holder 16 from entering passage 15.

Because of the relatively small size of initiator chamber 14 (diameter may be as small as 0.035 inches), it is difficult to machine the even smaller filter 30. In addition, adhesive must be applied to the threads on filter 30 and then the filter must be threaded into the passage 15. The present invention eliminates the separate filter 30, thereby saving the time and money of fabricating filter 30 and assembling filter 30 into initiator 10.

SUMMARY OF THE INVENTION

It is an object of the invention to provide a gas generating initiator having a drilled-in integral multi-port filter.

It is another object of the invention to provide a gas generating initiator with fewer parts than the prior art to thereby simplify manufacture and assembly.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
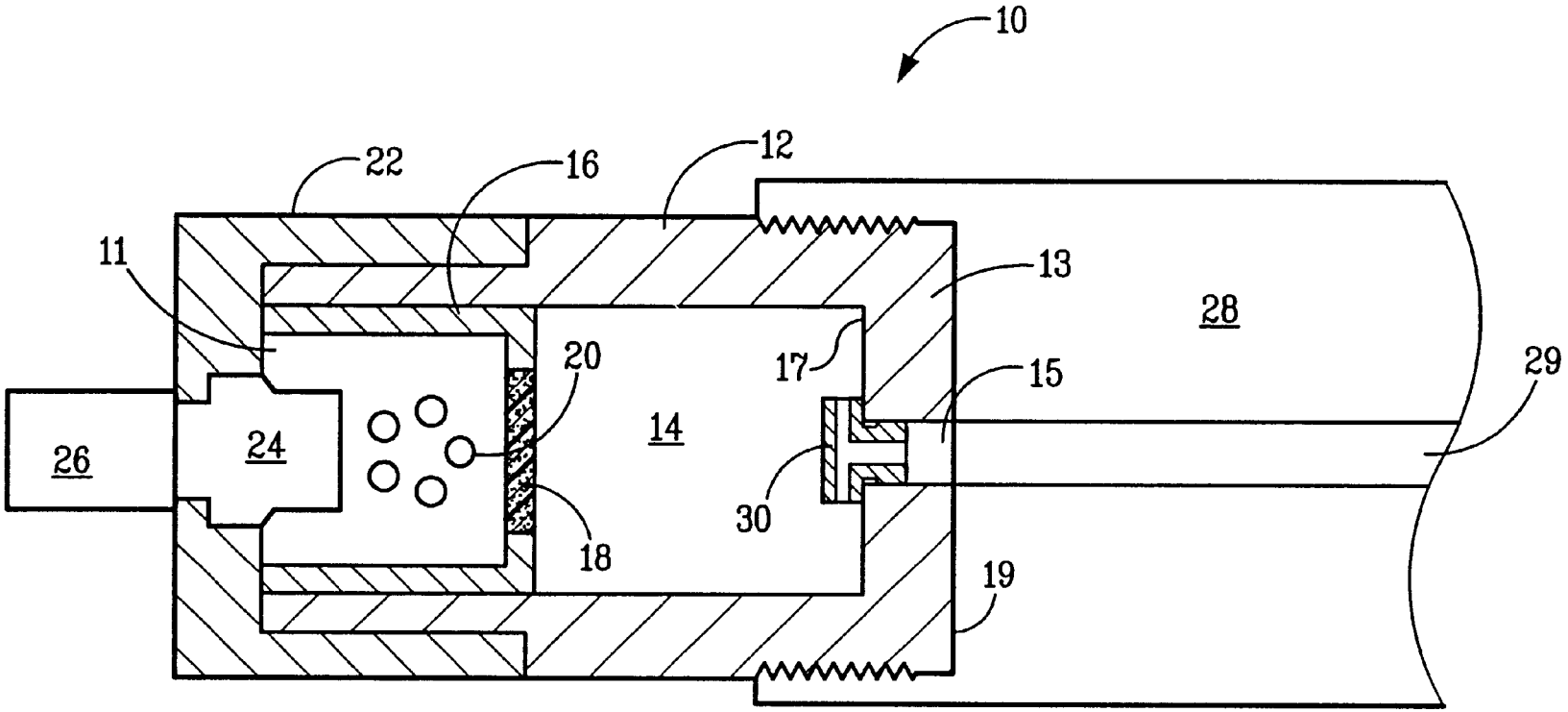
FIG. 1 Prior Art
FIG. 1 is a sectional view of a prior art gas generating initiator.
Figure 2A:
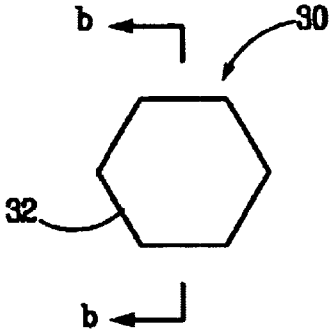
FIG. 2A Prior Art
FIG. 2*a* is a top view of a prior art filter.
Figure 2B:
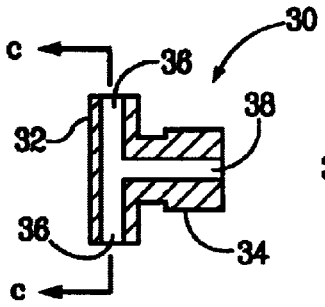
FIG. 2B Prior Art
FIG. 2*b* is a sectional view along the line b—b of FIG. 2*a*.
Figure 2C:
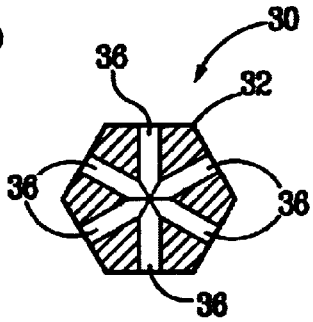
FIG. 2C Prior Art
FIG. 2*c* is a sectional view along the line c—c of FIG. 2*b*.
Figure 3:
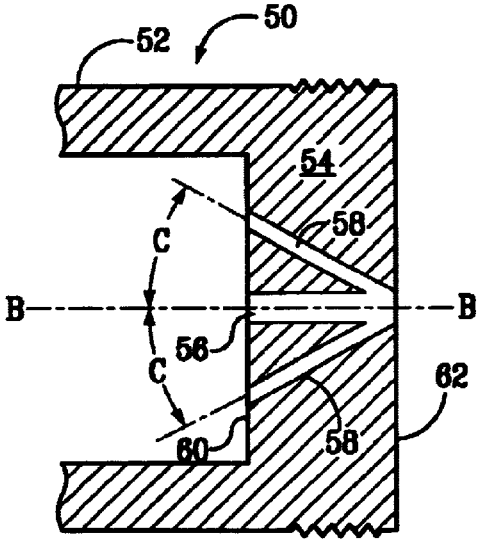
FIG. 3 is a partial section view of an initiator according to the invention.

The present invention includes a drilled-in integral multi-port filter that reduces the number of parts in an initiator. The reduction in parts simplifies manufacture and assembly. The separate filter 30 described above is eliminated. In its place are drilled-in holes in the base of the initiator body. FIG. 3 is a partial section view of an initiator 50 according to the invention. The separate filter 30 is eliminated. With the exception of the body 52, the other parts of the initiator 50 (charge holder, consumable membrane, propellant, cap, igniter, firing mechanism and nipple) are as described above with reference to FIG. 1.

The initiator 50 includes a generally cylindrical body 52 that defines an initiator chamber 14 therein. The body 52 is open at one end and closed at a second end by a base 54. The body 52 has a longitudinal axis B—B. The base 54 includes a generally centrally located first passage 56 therethrough. The first passage 56 has one end on an interior surface 60 of the base 54 and a second end on an exterior surface 62 of the base 54. A longitudinal axis of the first passage 56 is substantially coincident with the axis B—B of the body 52.

Base 52 also includes a plurality of second passages 58. The second passages 58 have one end on an interior surface 60 of the base 54 and a second end that intersects the first passage 56 at the second end of the first passage. Longitudinal axes of the second passages 58 form angles C with the longitudinal axis B—B of the first passage 56. A diameter of the first passage 56 is greater than diameters of the second passages 58. The number of the second passages 58 may vary, but the number is preferably in a range of two to ten.

The angles C between the longitudinal axes of the second passages 58 and the longitudinal axis B—B of the first passage 56 are in a range of about fifteen to about fifty degrees. The diameter of the first passage 56 is in range of about 0.05 to about 0.1 inches. The diameters of the second passages 58 are in a range of about 0.04 to about 0.07 inches. In a preferred embodiment, the diameter of the first passage 56 is about 0.078 inches and diameters of the second passages 58 are about 0.062 inches.

It is noted that the larger the angles C between the longitudinal axes of the second passages 58 and the longitudinal axis B—B of the first passage 56, the smaller the diameters of the second passages 58. This is required to keep the first passage 56 from becoming too large and allowing large particles to pass. Because of the small size of initiator 50, the second passages 58 must be drilled in the base 54 from the exterior surface 62 of the base. The diameter of the initiator chamber 14 is in a range of about 0.35 to about 1.5 inches. The diameter and angles C of second passages 58 are selected such that the opening of first passage 56 on the exterior surface 62 remains a circle. That is, the drill bit is inserted in first passage 56 at an angle to drill second passages 58.

Figure 4:
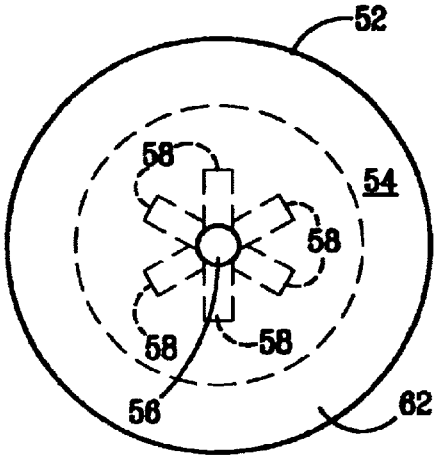
FIG. 4 is a bottom view of the body of the initiator of FIG. 3.
Figure 5:
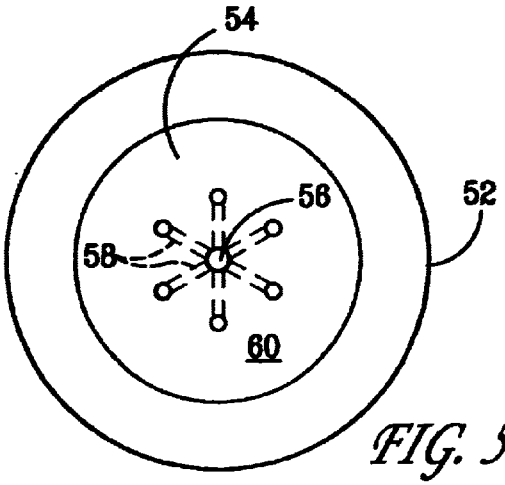
FIG. 5 is a top view of the body of FIG. 4.

FIG. 4 is a bottom view of the base 54 of the body 52 of FIG. 3. As shown in FIG. 4, only the opening of first passage 56 actually penetrates the exterior surface 62. FIG. 5 is a top view of the base 54 of the body 52 showing the central first passage 56 and six second passages 58.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An initiator, comprising:

a generally cylindrical body defining an initiator chamber therein, the body being open at one end and closed at a second end by a base, the body having a longitudinal axis;

the base including a generally centrally located first passage therethrough having one end on an interior surface of the base and a second end on an exterior surface of the base, a longitudinal axis of the first passage being substantially coincident with the axis of the body; and a plurality of second passages in the base, the second passages having one end on the interior surface of the base and a second end that intersects the first passage at the second end of the first passage, wherein longitudinal axes of the second passages form angles with the longitudinal axis of the first passage and wherein a diameter of the first passage is greater than diameters of the second passages.

2. The initiator of claim 1 further comprising a charge holder disposed in the open end of the body, the charge holder including a consumable membrane at one end and propellant disposed in the charge holder.

3. The initiator of claim 2 further comprising a cap attached to the open end of the body.

4. The initiator of claim 3 further comprising an igniter disposed in an opening in the cap and extending into the charge holder, the igniter igniting the propellant in the charge holder.

5. The initiator of claim 4 further comprising a firing mechanism connected to the igniter for firing the igniter.

6. The initiator of claim 5 further comprising a nipple attached to the base end of the initiator body, the nipple including a passageway therethrough wherein one end of the passageway mates with the second end of the first passage to provide a conduit for gas generated by the initiator.

7. The initiator of claim 1 wherein a number of the second passages is in a range of two to ten.

8. The initiator of claim 1 wherein the angles between the longitudinal axes of the second passages and the longitudinal axis of the first passage are in a range of about fifteen to about fifty degrees.

9. The initiator of claim 8 wherein the diameter of the first passage is in range of about 0.05 to about 0.1 inches.

10. The initiator of claim 9 wherein diameters of the second passages are in a range of about 0.04 to about 0.07 inches.

11. The initiator of claim 1 wherein a diameter of the initiator chamber is in a range of about 0.35 to about 1.5 inches.

12. The initiator of claim 9 wherein the diameter of the first passage is about 0.078 inches.

13. The initiator of claim 12 wherein the diameters of the second passages are about 0.062 inches.

* * * * *